US006818728B2

(12) United States Patent
Kato et al.

(10) Patent No.: US 6,818,728 B2
(45) Date of Patent: Nov. 16, 2004

(54) POLYKETONE FIBER AND PROCESS FOR PRODUCING THE SAME

(75) Inventors: Jinichiro Kato, Nobeoka (JP); Toru Morita, Nobeoka (JP); Ryu Taniguchi, Nobeoka (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 10/082,219

(22) Filed: Feb. 26, 2002

(65) Prior Publication Data

US 2003/0026981 A1 Feb. 6, 2003

(30) Foreign Application Priority Data

Feb. 27, 2001 (JP) ..... 2001-052718
Sep. 11, 2001 (JP) ..... 2001-274563

(51) Int. Cl.[7] ..... C08G 2/16; C08G 18/08
(52) U.S. Cl. ..... 528/220; 528/392; 528/488; 528/491
(58) Field of Search ..... 528/220, 392, 528/488, 491

(56) References Cited

U.S. PATENT DOCUMENTS 5,045,258 A 9/1991 van Breen et al.
5,929,150 A 7/1999 Ash

FOREIGN PATENT DOCUMENTS

EP 0 310 171 4/1989
EP 1 116 752 A1 7/2001
JP 2000-34620 2/2000
JP 2000-273720 10/2000
JP 2000-345431 12/2000
JP 2000-355825 12/2000
WO WO 90/14453 11/1990
WO WO 94/00623 1/1994
WO WO 94/16127 7/1994
WO WO 99/18143 4/1999

OTHER PUBLICATIONS

Kato et al, Polyketone fibers with high tensile strength manufactured by spinning carbon–monoxide–olefin copolymer—composite materials therefrom, 2000, Chem Abstract 134: 18440.*

Kato et al"polyketone aqueous solutions useful for manufacture of fibers", 2000, Chem Abstract 132: 167161.*

* cited by examiner

*Primary Examiner*—Duc Truong
(74) *Attorney, Agent, or Firm*—Finnegan, Henderson, Farabow, Garrett & Dunner, L.L.P.

(57) ABSTRACT

Disclosed are polyketone fibers which contain a ketone unit represented by —$CH_2CH_2$—CO— as a main repeating unit, and have an intrinsic viscosity of not less than 0.5 dl/g, a crystal orientation of not less than 90%, a density of not less than 1.300 g/cm$^3$, an elastic modulus of not less than 200 cN/dtex, and a heat shrinkage of −1 to 3%. The polyketone fibers are high in strength and elastic modulus, and excellent in fatigue resistance, processability, heat resistance, dimensional stability, and, besides, adhesion, and, therefore, can be applied to the fields which require high fatigue resistance, such as tire cords, belts, hoses, ropes, etc.

11 Claims, No Drawings

POLYKETONE FIBER AND PROCESS FOR PRODUCING THE SAME

BACKGROUND OF THE INVENTION

1. Field of the Invention

The present invention relates to polyketone fibers and a process for producing the polyketone fibers. More particularly, it relates to polyketone fibers applicable to the fields which require high fatigue resistance, such as tire cords, belts, hoses, ropes, etc., and a process for producing the polyketone fibers.

2. Description of the Related Art

It is known that when carbon monoxide and an olefin such as ethylene or propylene are polymerized using a complex of a transition metal such as palladium or nickel as a catalyst, a polyketone which is a substantially complete alternating copolymer of carbon monoxide and an olefin can be obtained ("Kogyo Zairyo (Industrial Material)", December, page 5, 1997). Moreover, investigations on use of polyketones as fibers for industrial materials have been made by many researchers, and it is expected to use polyketone fibers in the form of twist yarn cords as fibers for composite materials such as reinforcing fibers for tire cords and belts utilizing the excellent characteristics of polyketones, namely, high strength and high elastic modulus, and dimensional stability, adhesion and creep resistance at high temperatures.

Since a polyketone when molten is apt to be thermally crosslinked, it is preferred to employ wet spinning for making it into fibers. Especially, fibers of a polyketone comprising substantially only carbon monoxide and ethylene (poly(1-oxotrimethylene)) which have excellent mechanical properties are readily crosslinked with heat. Therefore, the fibers are very difficult to produce by melt spinning and they can be obtained substantially only by wet spinning.

When a polyketone is subjected to wet spinning, it is known to use organic solvents, for example, phenolic solvents such as hexafluoroisopropanol, m-cresol and resorcin/water, and resorcin/carbonate (JP-A-2-112413, JP-A-4-228613, JP-A-7-508317). However, fibers obtained by wet spinning using these solvents are readily fibrillated, and are insufficient in fatigue resistance and processability to be used as industrial materials. Furthermore, these solvents are highly toxic and combustible and suffer from the problem that large measures must be taken against the toxicity and the combustibility of solvents for making a spinning equipment of industrial scale.

On the other hand, these methods are proposed which carry out spinning of a polyketone solution prepared by dissolving a polyketone in an aqueous solution containing a zinc halide such as zinc chloride or zinc bromide or a lithium salt such as lithium bromide, lithium iodide or lithium thiocyanate in a specific concentration (WO99/18143, U.S. Pat. No. 5,955,019). The above aqueous solution is relatively inexpensive, low in toxicity and non-combustible, and are excellent as solvents for polyketones. Moreover, these documents disclose that a strength of 1.5 GPa was attained for monofilaments in a laboratory test. However, according to the tracing experiments conducted by the inventors, when the fibers obtained by using the above solvents are made into the form of multifilaments required for industrial materials, it is difficult to attain a strength exceeding 1.5 Gpa, and, besides, they are insufficient in fatigue resistance and processability to be used as industrial materials. Further, it is difficult to perform stable spinning with less fluffing or breakage.

As a result of investigations conducted on the reasons for the insufficient fatigue resistance and processability of polyketone fibers obtained by the known spinning methods, it has been found that the conventional polyketone fibers have a skin-core structure, in which the surface portions is dense and the central portion is sparse. That is, it is considered that in the case of a structure where the inner portion of fibers being sparse, it is difficult to develop high strength and elastic modulus as fibers, and when the fibers are subjected to processing such as twisting, heat treatment, weaving or knitting, or when they are practically used for industrial materials, the fibers cannot stand compression or repeated extension to cause deterioration of strength or extension, resulting in insufficient fatigue resistance and processability. According to the further investigations conducted by the inventors, it has been found that such skin-core structure is formed owing to the difference in coagulation speed of the surface portion of the fibers and the inner portion of the fibers in the coagulation step. At the coagulation step, the solution of the coagulating bath penetrates into the inner portion of fibers from the surface of the fibers and solidifies the fibers, resulting in difference in coagulation speed between the surface portion and the central portion of the fibers.

Therefore, there is a high possibility of obtaining fibers of high fatigue resistance and processability if polyketone fibers having a uniform and dense inner structure can be produced, but substantially no such investigations have been conducted, and fibers having a uniform and dense inner structure have not yet been obtained.

The first object of the present invention is to provide polyketone fibers having a uniform and dense structure, and, thus, there are provided polyketone fibers which are high in strength and elastic modulus, excellent in fatigue resistance, processability, heat resistance and dimensional stability, and especially suitable for industrial materials. The second object of the present invention is to provide a process for producing the polyketone fibers.

SUMMARY OF THE INVENTION

That is, the polyketone fibers of the present invention comprise a polyketone containing a ketone unit shown by the following formula (1) as a main repeating unit, and have an intrinsic viscosity of not less than 0.5 dl/g, a crystal orientation of not less than 90%, a density of not less than 1.300 g/cm$^3$, an elastic modulus of not less than 200 cN/dtex, and a heat shrinkage of −1 to 3%.

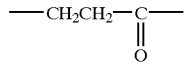

(1)

Furthermore, the polyketone fibers of the present invention can be produced by wet spinning a polyketone solution having a phase separation temperature in the range of 0–150° C.

DETAILED DESCRIPTION OF THE INVENTION

First, the polyketone constituting the polyketone fibers of the present invention will be explained. The polyketone contains a ketone unit represented by the above formula (1) as a main repeating unit. In the present invention, repeating units other than the repeating unit of the formula (1), for example, a ketone unit represented by the following formula (2) may be contained in an amount of less than 15 mole % based on the total repeating units.

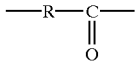

(2)

In the formula (2), R is an organic group of 1–30 carbon atoms other than ethylene, and includes, for example, propylene, butylene, 1-phenylethylene, etc. A part or all of hydrogen atoms of these groups may be substituted with a halogen group, an ester group, an amide group, a hydroxyl group or an ether group. Of course, R may comprise 2 or more organic groups, and, for example, propylene and 1-phenylethylene may be present together.

However, if the amount of the repeating unit other than the repeating unit of the formula (1) increases, strength, elastic modulus, dimensional stability and heat resistance are deteriorated, and, hence, the amount of the ketone unit of the formula (1) is preferably not less than 97 mole %, more preferably not less than 98 mole %, further preferably not less than 99 mole % based on the total repeating units. In the present invention, it is most preferred that the polyketone fibers comprise only the ketone unit represented by the formula (1) (100 mole % based on the total repeating units).

Furthermore, if necessary, these polyketones may contain additives such as antioxidants, radical inhibitors, other polymers, matting agents, ultraviolet absorbers, flame-retarding agents, metallic soaps, etc.

The polyketone fibers of the present invention have an intrinsic viscosity of not less than 0.5 dl/g, preferably 1–20 dl/g, more preferably 2–10 dl/g, especially preferably 3–8 dl/g. If the intrinsic viscosity is less than 0.5 dl/g, molecular weight is too low and strength or fatigue resistance of the polyketone fibers is insufficient. Moreover, since the physical properties (strength, ductility) of the coagulated filaments are deteriorated, many troubles such as fluffing, breakage, etc. occur during spinning, drying and stretching. On the other hand, there are no special restrictions in the upper limit of the intrinsic viscosity, but if the intrinsic viscosity exceeds 20 dl/g, not only the polymerization reaction requires time and cost, but also uniform dissolution of polyketone in the production of fibers becomes difficult to give adverse effects on the spinnability and physical properties of fibers.

The polyketone fibers of the present invention have a crystal orientation of not less than 90%, preferably not less than 95%, more preferably not less than 97%. If the crystal orientation is less than 90%, orientation of molecular chains is insufficient, and strength, elastic modulus, fatigue resistance and dimensional stability of the fibers cannot be said to be sufficient.

The polyketone fibers of the present invention have a density of not less than 1.300 g/cm$^3$, preferably not less than 1.310 g/cm$^3$, more preferably not less than 1.320 g/cm$^3$. Since the polyketone fibers having a density of less than 1.300 g/cm$^3$ have voids in the fibers or have a considerable skin-core structure, they lack denseness and inferior in fatigue resistance. As to the upper limit of the density, the density is preferably not more than 1.350 g/cm$^3$ from the viewpoint of fatigue resistance.

The polyketone fibers of the present invention have an elastic modulus of not less than 200 cN/dtex. For the development of a sufficient performance in the uses of industrial materials, particularly, those which require stiffness, such as tire codes, belts, hoses, ropes, tension members, etc., they have an elastic modulus of preferably not less than 250 cN/dtex, more preferably not less than 300 cN/dtex, most preferably not less than 400 cN/dtex. As to the upper limit of the elastic modulus, it is preferably not more than 1000 cN/dtex from the viewpoint of fatigue resistance.

The polyketone fibers of the present invention have a heat shrinkage at 150° C. of −1 to 3%, preferably −1 to 1.5%, more preferably 0 to 1.5%, especially preferably 0 to 1%. If the heat shrinkage exceeds 3%, dimensional change of articles is large during processing or using to cause deterioration of the products. On the other hand, if the heat shrinkage is less than −1%, the similar problems occur.

The polyketone fibers of the present invention have a maximum heat shrinkage stress of preferably 0.01–0.7 cN/dtex, more preferably 0.01–0.6 cN/dtex, further preferably 0.02–0.5 cN/dtex, most preferably 0.03–0.3 cN/dtex. If the heat shrinkage stress is too high, the fibers are tightly wound up in winding operation to make it difficult to detach the packages from the winder, or products shrink and undergo distortion when they are exposed to heat during processing or using. In some cases, performance of products is considerably deteriorated due to the deformation. On the other hand, if the maximum heat shrinkage stress is too low, the shape cannot be fixed by heat setting at processing, and the formed products are apt to become loose.

In the polyketone fibers of the present invention, sticking ratio of single filaments of the fibers is preferably not more than 30%, more preferably not more than 20%, further preferably not more than 10%. The term "sticking ratio of single filaments" here is defined by the following formula.

$$\text{Sticking ratio of single filaments (\%)} = \{1 - (\text{apparent number of single filaments}/\text{number of single filaments})\} \times 100$$

In the formula, "apparent number of single filaments" means the number obtained in the following manner. The polyketone fibers are lightly rubbed twenty times by a chalk on a black board to loosen the fibers, and then the number of filaments is counted using a 100× magnifying glass, where the filaments which stick to each other and cannot be separated from each other are counted as one single filament. Evaluation is conducted three times and the average value thereof is taken as "apparent number of single filaments". A specific example thereof will be explained. For example, in the case of fibers produced using a spinneret having 10 holes, if there are 2 sets of single filaments, one set of which consists of 2 single filaments which stick to each other, the number of the single filaments is 10, and the apparent number of the single filaments is 8, and thus the sticking ratio of single filaments is 20%.

If the sticking ratio of single filaments is high, strength retention rate during twisting of fibers (a value obtained by dividing strength after twisting by strength before twisting) considerably decreases, and, besides, breakage of many single filaments occurs. Therefore, when the fibers are used for industrial materials such as tire cords, the inherent performance of the fibers per se cannot be sufficiently exhibited.

From the point of improvement of fatigue resistance, the polyketone fibers of the present invention preferably have a strength retention rate of not less than 50% when they are subjected to twisting of 390 T/m. The strength retention rate is more preferably not less than 60% and more preferably not less than 70%.

In the polyketone fibers of the present invention, the total amount of the elements Pd and Zn contained in the fibers is preferably not more than 50 ppm based on the weight of the fibers. In the polyketone fibers, there are various metallic residues originating from polymerization catalysts or solvents, and, particularly, Pd and Zn adversely affect the development of strength and elastic modulus, fatigue resistance and heat resistance. Therefore, it is preferred to reduce the total amount of them. The total amount of the elements Pd and Zn is preferably not more than 30 ppm and more preferably not more than 10 ppm.

For developing sufficient performances as industrial materials, the polyketone fibers of the present invention preferably have a strength of not less than 7 cN/dtex, and the strength is more preferably not less than 14 cN/dtex, further preferably 17 cN/dtex. By employing the production process of the present invention mentioned hereinafter, it becomes possible to develop a strength of not less than 17.6 cN/dtex which is a strength of so-called super fibers.

The fineness of the polyketone fibers of the present invention has no special limitation, but the fineness of single filament is preferably 0.01–10 dtex. For the retention of high mechanical properties of the polyketone fibers, the fineness of single filament is more preferably 0.5–10 dtex, further preferably 0.7–3 dtex, especially preferably 0.7–1.8 dtex. The total fineness has also no special limitation, and is usually 5–30000 dtex, and preferably 100–5000 dtex in order to use them as industrial materials.

There is no limitation in the form of the polyketone fibers of the present invention, and they may be any forms of long fibers (filaments), short fibers, pulp-like fibers, etc. The long fibers may optionally contain entanglements or twists, and the entangling degree is preferably 1–1000 from the points of easiness in removal from wind-up packages and in processing. The fiber length in the short fibers has no special limitation, but is usually 0.5–300 mm from the point of easiness in processing in spinning, and the fibers may optionally have at least one crimp, preferably 1–30 crimps per 30 mm. The sectional shape may be circular, triangular, elliptic, rice ball-like, or optional irregular shapes having an irregularity degree (ratio of circumcircle and inscribed circle of the section) of not less than 1.1.

The polyketone fibers of the present invention have a coefficient of dynamic friction between fiber-fiber (hereinafter referred to as "$\mu$") of preferably 0.01–3.0, more preferably 0.1–2.7, further preferably 0.1–2.5. If the $\mu$ is less than 0.01, the dynamic friction between fiber-fiber is too small and slippage occurs at the twisting step, and a sufficient number of twists cannot be given to the fibers. Further, if the $\mu$ is larger than 3.0, the dynamic coefficient between fiber-fiber is too large even if a finishing agent referred to hereinafter is applied, and the fibers are apt to be damaged at the twisting step, resulting in deterioration of fatigue resistance.

In order that the $\mu$ is in the above-mentioned range, a finishing agent can be applied to the surface of the fibers. The application amount of the finishing agent is preferably 0.2–7% by weight, more preferably 0.5–3.5% by weight, further preferably 0.7–1.5% by weight based on the weight of the fibers. If the amount of the finishing agent applied onto the fibers is less than 0.2% by weight, the effect to improve the abrasion resistance decreases. If it exceeds 7% by weight, resistance during running of the fibers becomes too large or the finishing agent sticks to rolls, hot plates, guides, etc. to contaminate them. Of course, the finishing agent may partly penetrate into the fibers.

The finishing agent used here is a liquid or solid agent which adheres to the surface of the fibers or the surface of the fibers and the surface layer portion of the fibers and modifies the surface of the fibers. The finishing agent used in the present invention has no special limitation, but preferably comprises at least one compound selected from the group consisting of the following compounds (i)–(iii) as an essential component with the total amount of the essential components being 30–100% by weight based on the total finishing agents.

(i) An ester compound having a molecular weight of 300–2000.

(ii) A mineral oil.

$$R^1—O—(CH_2CH_2O)_n—(CH(CH_3)CH_2O)_m—R^2 \quad \text{(iii)}$$

where $R^1$ and $R^2$ each represents a hydrogen atom or an organic group of 1–50 carbon atoms, and n and m are 1–500, and the ethylene oxide unit and the propylene oxide unit may form block copolymer or random copolymer.

By applying the finishing agent to the polyketone fibers, an oil film is formed on the surface of the polyketone fibers, and the surface of the fibers slips due to the presence of this oil film. Therefore, even if the fibers are twisted, the fibers are not abraded in a short period of time.

Furthermore, in order to impart antistatic properties to the fibers, the finishing agent may contain known phosphates, phosphites, sulfonates or carboxylates in the range of 0.5–20% by weight.

The process for producing the polyketone fibers of the present invention will be explained below.

The inventors have found that by using not the conventional coagulation process in which a coagulation solution is allowed to penetrate into the fibers from the surface of the fibers to solidify the fibers, but a process in which first a polyketone solution having a phase separation temperature in a specific range and having one phase at a high temperature and two phases at a low temperature is kept at a temperature higher than the phase separation temperature and then is discharged into a coagulating bath of low temperatures lower than the phase separation temperature, thereby to allow the polyketone to gel, and thus polyketone fibers having a dense and uniform structure even in the inner part can be obtained.

That is, the polyketone fibers of the present invention can be produced by wet spinning a polyketone solution which comprises a polyketone containing a ketone unit represented by the above formula (1) as a main repeating unit and having a molecular weight distribution of 1–6 and a Pd content of not more than 50 ppm and a solvent for dissolving the polyketone and which has a phase separation temperature in a range of 0–150° C. More specifically, the polyketone fibers can be produced by heating the above polyketone solution to a temperature higher than the phase separation temperature, then extruding the solution into a coagulating bath having a temperature lower than the phase separation temperature to form a fibrous material, thereafter removing a part or the whole of the solvent which dissolves the polyketone from the fibrous material, stretching the fibrous material and winding up the fibrous material.

First, polyketone to be spun (hereinafter sometimes referred to as "starting polyketone") will be explained.

The chemical structure (monomer composition) of the starting polyketone is as explained above.

The intrinsic viscosity of the starting polyketone is preferably not less than 1 dl/g from the points of strength and fatigue resistance of the resulting polyketone fibers, and preferably 2–20 dl/g in view of stretchability. It is more preferably 4–20 dl/g, and most preferably 4–10 dl/g.

It is necessary that the molecular weight distribution of the starting polyketone is 1–6. If it is more than 6, even when the solution is rapidly cooled from the solution state to a temperature lower than the phase separation temperature, a long time is required to reach the gelling state, and as a result a phase separation partially occurs with the coagulation solution. Therefore, the inner structure of the resulting fibers can hardly become sufficiently uniform, and strength, elastic modulus and fatigue resistance of the resulting fibers are not sufficiently high. The molecular weight distribution is preferably 1–4, more preferably 1–3, and most preferably 1–2.

It is necessary that the amount of the element Pd contained in the starting polyketone is not more than 50 ppm based on the weight of the fibers. If it exceeds 50 ppm, heat stability of the polyketone solution is deteriorated. The amount is preferably not more than 30 ppm, more preferably not more than 10 ppm, and is desirably as close to 0 ppm as possible in the present invention.

As for the process for the production of the starting polyketone, known processes as they are or as modified can be used. For example, the starting polyketone can be synthesized by polymerizing carbon monoxide and an olefin such as ethylene, propylene, or the like in the presence of a catalyst containing a compound of a transition metal of Group 9 or 10, a phosphorus-based bidentate ligand represented by the following formula (3) and an acid having a pKa of not more than 4.

$$R^3R^4P—R^5—PR^6R^7 \quad (3)$$

(in the formula, $R^3$, $R^4$, $R^6$ and $R^7$ represent independently an organic group of 1–30 carbon atoms, and $R^5$ represents an organic group of 2–5 carbon atoms).

As the compounds of transition metals of Groups 9 and 10, mention may be made of compounds of palladium, nickel, cobalt, etc., and palladium is especially preferred from the viewpoint of polymerization activity. For using them as catalysts, they are preferably used as carboxylates, particularly, acetates.

As the phosphorus-based bidentate ligands, preferred are those in which at least one of $R^3$, $R^4$, $R^6$ and $R^7$ of the above formula (3) is a substituted phenyl group and this phenyl group contains at least one alkoxy group in the ortho position in respect to the phosphorus element to which the phenyl group bonds. Specifically, o-methoxyphenyl group and o-ethoxyphenyl group are preferred. When an unsubstituted phenyl group is used, the molecular weight distribution sometimes becomes great. Furthermore, $R^5$ which links the two phosphorus atoms is preferably a trimethylene group.

As the acid having a pKa of not more than 4, mention may be made of sulfuric acid, trifluoroacetic acid, difluoroacetic acid, trichloroacetic acid, p-toluenesulfonic acid, etc.

The polymerization is carried out by adding a catalyst comprising the compound of transition metal of Groups 9 and 10, the phosphorus-based bidentate ligand represented by the formula (3) and anion of the acid having a pKa of not more than 4 to a lower alcohol such as, for example, methanol or ethanol, followed by introducing carbon monoxide and an olefin into this solution. The molar ratio of the carbon monoxide and the olefin is preferably 5:1–1:5. The compound of transition metal of Group 9 or 10 used as the catalyst preferably has a content of the metal element corresponding to $10^{-8}$–0.1 mole per 1 mole of the olefin used for the polymerization from the point of polymerization activity. It is particularly preferred for attaining the object of the present invention to set the charging amount of the metal compound of the transition metal belonging to Group 9 or 10 so that the amount of Pd is not more than 50 ppm based on the total weight of the resulting polyketone. From the viewpoint of polymerization activity, the amount of the phosphorus-based bidentate ligand is preferably 0.1–20 moles, more preferably 1–3 moles based on 1 mole of the compound of Group 9 or 10 transition metal. The amount of the acid having a pKa of not more than 4 is preferably 0.01–150 equivalent, especially preferably 1–50 equivalent per 1 gram atom of the compound of Group 9 or 10 transition metal.

Temperature and pressure at the polymerization are preferably 60–200° C. and 4–20 MPa, respectively. If the polymerization temperature is lower than 60° C. or higher than 200° C., the molecular weight distribution is sometimes outside the range of the present invention.

Moreover, in order to maintain the catalyst activity during polymerization and increase the heat resistance of the resulting polyketone, a quinone such as 1,4-benzoquinone, 1,4-naphthoquinone, or the like may be added in an amount of 0.1–500 times the mole of the catalyst metal element.

The polyketone may be produced by so-called gas phase polymerization with supporting the above-mentioned catalyst on polymers, inorganic powders, etc. The gas phase polymerization is rather preferred because the catalyst hardly remains in the polyketone.

It is preferred that the resulting polyketone is subjected to filtration and washing to wash away the remaining catalyst or quinone or oligomers present in a slight amount to keep the amount of Pd and the molecular weight distribution in preferred ranges, followed by drying. Examples of the solvents used for the washing are alcohols such as methanol, ethanol, propanol, etc., ethers such as dioxane, tetrahydrofuran, diethyl ether, etc., ketones such as acetone, methyl ethyl ketone, 2,4-pentanedione, etc., and hydrocarbons such as pentane, hexane, petroleum ether, etc. The washing temperature has no special limitation, and is, for example, 0–80° C., and the washing time also has no special limitation, and, for example, is 10 seconds—1 hour for one washing.

The resulting starting polyketone can be made to a polyketone solution by dissolving in a specific solvent.

The polyketone solution used for producing the polyketone fibers of the present invention must have a phase separation temperature in the range of 0–150° C. When a polyketone solution which has a phase separation temperature in the range of 0–150° C. and which is at a temperature higher than the phase separation temperature is extruded from a spinneret and coagulated in a coagulating bath of lower than the phase separation temperature, the discharged polyketone solution immediately gels up to the inside of the fibers to form a dense and uniform structure. When the solvent is removed from the gel-like fibers, followed by stretching the fibers, dense and uniform polyketone fibers are formed with a low sticking ratio of single filaments. Thus, fibers high in strength and elastic modulus and excellent in fatigue resistance and dimensional stability are obtained.

If the phase separation temperature is higher than 150° C., the polymer during preparation of the polyketone solution sometimes undergoes chemical crosslinking or decomposition, resulting in deterioration of the physical properties of the polyketone fibers. If the phase separation temperature is lower than 0° C., only such fibers having a skin-core structure can be obtained and they are insufficient in strength and fatigue resistance.

In the present invention, the phase separation temperature is more preferably 20–120° C., further preferably 30–100° C.

The phase separation temperature here is a temperature at which polyketone becomes insoluble in the solvent and the solution begins to become non-uniform when the polyketone solution in which the polyketone substantially uniformly dissolves is gradually cooled. This non-uniform state can be determined by the light transmittance of the solution. The phase separation temperature in the present invention can be obtained by the following two methods, and either method may be used because substantially the same value is obtained by these methods. According to the simplest method, a glass vessel of 25 mm in diameter×800 mm in length is filled with a uniform polyketone solution of high temperature, the solution is cooled and left to stand at a specific temperature for at least 30 minutes, and a temperature at which the solution begins not transmit the light in the diameter direction of the glass vessel is taken as the phase separation temperature. According to another method, the temperature is obtained from transmittance of laser beams. When the polyketone solution becomes non-uniform, scattering of light increases to cause decrease of quantity of light which transmits linearly as compared with the polyketone solution in which the polyketone is substantially uniformly dissolved. Under gradually cooling a polyketone solution in which the polyketone is substantially uniformly dissolved (the light transmittance of the solution in this case being referred to as "T1") at a rate of 10° C. per 1 hour, temperature and light transmittance of the polyketone solution are measured (the light transmittance of the solution in this case being referred to as "T2"), and reduction rate of the light transmittance is obtained by the following formula.

$$\text{Reduction rate of light transmittance (\%)}=\{(T1-T2)/T1\}\times 100$$

The temperature of the polyketone solution at which the reduction rate of the light transmittance reaches 10% is taken as the phase separation temperature. The sample length is 10 mm, and the light transmittance is measured using a laser beam of 632.8 nm in wavelength as a light source.

The solvents of the polyketone solution, namely, solvents which dissolve the starting polyketone, have no special limitation as far as they have a phase separation temperature in the above range, and may be aqueous solutions or organic solvents.

However, the solvents for dissolving the starting polyketone are preferably solutions which contain at least one metal salt selected from the group consisting of zinc salts, calcium salts, lithium salts, thiocyanates and iron salts from the points of strength, fatigue resistance and processability of the resulting polyketone fibers. Specifically, the zinc salts include zinc chloride, zinc bromide, zinc iodide, etc., the calcium salts include calcium chloride, calcium bromide, calcium iodide, etc., the thiocyanates include calcium thiocyanate, barium thiocyanate, etc., the lithium salts include lithium chloride, lithium bromide, lithium iodide, etc., and the iron salts include iron bromide, iron iodide, etc. Of these metal salts, it is especially preferred from the points of solubility of the starting polyketone, cost, and stability of the resulting polyketone solution to use at least one metal salt selected from the group consisting of zinc halides such as zinc chloride, zinc bromide, zinc iodide, etc., calcium chloride, calcium bromide, lithium chloride, lithium bromide, and iron bromide.

As the solvents for dissolving the above metal salts, there may be used water, alcohols such as methanol, ethanol, benzyl alcohol, etc., acetone, methyl ethyl ketone, ethyl acetate, methyl acetate, dimethyl sulfoxide, N-methylpyrrolidone, N,N-dimethylacetamide, and N,N-dimethylformamide. If necessary, these solvents may be mixtures of two or more. From the point of solubility of the starting polyketone, water and methanol are preferred, and from the points of non-combustibility, non-toxicity and cheapness, water is especially preferred.

For water, there is no limitation as far as it can be industrially used, and optional water such as potable water, river water, deionized water, etc. can be used. Furthermore, water may contain organic solvents such as methanol, ethanol, ethylene glycol, acetone, dimethyl sulfoxide, N-methylpyrrolidone, etc., in such a range as not hindering the polyketone dissolving power in the aqueous solution containing the above metal salts, usually, in an amount of not more than 30% by weight of water.

Furthermore, for the control of the phase separation temperature, improvement of dissolution, reduction of viscosity and improvement of stability of the polyketone solution, especially preferred is to add a salt which dissolves in an amount of not less than 1% by weight to the solvent for dissolving the above metal salt, more preferably to water of 50° C. in addition to the above metal salts. Here, the salt added in addition to the metal salts can be optionally selected depending on various uses, and examples thereof are inorganic salts such as halogenated salts, sulfates, phosphates, nitrates, etc. and organic metal salts such as acetates, formates, sulfonates, etc. Of course, the aforementioned zinc salts, calcium salts, lithium salts, thiocyanates and iron salts may be used in admixture of two or more. Specific examples thereof are metal salts such as calcium chloride, lithium chloride, calcium thiocyanate, sodium chloride, barium chloride, magnesium chloride, sodium bromide, barium bromide, magnesium bromide, sodium iodide, barium iodide, iron chloride, etc., and organic salts such as trialkylphosphonium chloride, trialkylphosphonium bromide, etc. may also be used.

Here, concentration of at least one metal salt selected from the group consisting of the zinc salts, calcium salts, thiocyanates, lithium salts and iron salts is preferably 15–77% by weight. If the concentration is lower than 15% by weight, the fibrous material drawn up from the bath at the spinning step tends to be brittle and readily broken. If the concentration of the metal salt is higher than 77% by weight, the gelling speed in the coagulating bath is low and breakage is apt to occur during drawing up from the coagulating bath. The concentration is more preferably 30–77% by weight, and most preferably 40–70% by weight. The concentration of the metal salt in the solution here is a value defined by the following formula.

$$\text{Concentration of metal salt (\% by weight)}=\{\text{weight of metal salt}/(\text{weight of metal salt}+\text{weight of solvent for dissolving the metal salt})\}\times 100$$

In the above formula, "weight of solvent for dissolving metal salt" is the weight of water, methanol, etc. mentioned above, and does not include the weight of the starting polyketone.

Concentration of the salt added in addition to the above metal salt is preferably 0.1–60% by weight, especially preferably 1–40% by weight, most preferably 1–30% by weight based on the total of the weight of the solvent for dissolving the metal salt and weight of all salts (the total weight of the metal salt and the salt additionally added).

Concentration of the starting polyketone in the polyketone solution is preferably 1–40% by weight. If the concentration of the starting polyketone is less than 1% by weight, this concentration is too low, and it becomes difficult to allow the polyketone solution to gel and make fibrous at the spinning step, and, in addition, production cost of fibers increases. If the concentration is higher than 40% by weight, the starting polyketone no longer dissolves in the solvent. The concentration of the starting polyketone is more preferably 1–30% by weight, further preferably 3–20% by weight from the viewpoints of solubility, easiness of spinning and production cost of the fibers. The concentration of the starting polyketone here is a value defined by the following formula.

Concentration of starting polyketone (% by weight)={weight of starting polyketone/(weight of starting polyketone+weight of solvent for dissolving the starting polyketone)}×100

In case the solvent for dissolving the starting polyketone is a solution containing the above metal salt and the above salt added in addition to the metal salt, "weight of solvent for dissolving the starting polyketone" includes the weight of the metal salt and the salt added in addition to the metal salt.

The polyketone solution having a phase separation temperature in the range of 0–150° C. can be prepared by adjusting the chemical structure (monomer composition) and the intrinsic viscosity of the starting polyketone, the kind and the concentration of the metal salt added to the solvent for dissolving the starting polyketone, the kind of the solvents for dissolving the starting polyketone and the metal salt, the concentration of the starting polyketone, etc.

For example, the procedure for determination of the concentration of the metal salt so that the phase separation temperature of the polyketone solution can be in the range of 0–150° C. is as follows. First, a given amount of the metal salt is previously added to the solvent for dissolving the starting polyketone, then a given amount of the starting polyketone is added thereto and these are mixed, and the temperature is raised and the starting polyketone is dissolved with stirring until a substantially uniform and transparent polyketone solution is formed. Thereafter, the phase separation temperature is measured by the above-mentioned method. When the resulting phase separation temperature is higher than the desired value, the concentration of the metal salt in the solvent is increased, and when it is lower than the desired value, the concentration of the metal salt is decreased. By repeating such procedures, the concentration of the metal salt to give a polyketone solution having the desired phase separation temperature is determined.

Specifically, in case poly(1-oxotrimethylene) having a molecular weight distribution of 2 and an intrinsic viscosity of 5.0 dl/g is dissolved in an aqueous solution containing zinc chloride and calcium chloride as metal salts (the weight ratio of zinc chloride and calcium chloride being 45/55–55/45) so that the concentration of the starting polyketone can be in the range of 5–15% by weight, the range of the concentration of the metal salts for obtaining a polyketone solution having a phase separation temperature in the range of 0–150° C. is 55–67% by weight.

In case the similar poly(1-oxotrimethylene) is dissolved in an aqueous solution containing zinc chloride and sodium chloride as metal salts (the weight ratio of zinc chloride and sodium chloride being 75/25–95/5) so that the concentration of the starting polyketone can be in the range of 5–15% by weight, the range of the concentration of the metal salts for obtaining a polyketone solution having a phase separation temperature in the range of 0–150° C. is 65–70% by weight.

In order to obtain polyketone fibers having high strength and high elastic modulus and good fatigue resistance and dimensional stability, the kind of the solution containing the above specific metal salts which is used as a solvent for dissolving the starting polyketone and the kind and the composition of the metal salts contained in the solution are especially preferably the following four cases.

(a) Aqueous solutions containing zinc chloride and calcium chloride: The weight ratio of zinc chloride and calcium chloride is 29/71–44/56, more preferably 32/68–39/61. The concentration of the total metal salts of zinc chloride and calcium chloride is 58–64% by weight, more preferably 60–63% by weight.

(b) Aqueous solutions containing zinc chloride, calcium chloride and lithium chloride: The weight ratio of zinc chloride and the total of calcium chloride and lithium chloride is 29/71–44/56, more preferably 32/68–41/59, wherein the weight ratio of calcium chloride and lithium chloride is 49/51–91/9, preferably 64/37–88/18. The concentration of the total metal salts of zinc chloride, calcium chloride and lithium chloride is 58–64% by weight, more preferably 60–63% by weight.

(c) Aqueous solutions containing zinc chloride, calcium chloride and calcium thiocyanate: The weight ratio of zinc chloride and the total of calcium chloride and calcium thiocyanate is 29/71–44/56, more preferably 32/68–41/59, wherein the weight ratio of calcium chloride and calcium thiocyanate is 76/24–99.5/0.5, more preferably 85/15–98.5/1.5. The concentration of the total metal salts of zinc chloride, calcium chloride and calcium thiocyanate is 58–64% by weight, more preferably 60–63% by weight.

(d) Aqueous solutions containing zinc chloride and calcium thiocyanate: The weight ratio of zinc chloride and calcium thiocyanate is 32/68–49/51, more preferably 35/65–46/54. The concentration of the total metal salts of zinc chloride and calcium thiocyanate is 57–65% by weight, more preferably 60–63% by weight.

The process for preparing the polyketone solution has no special limitation, and preferred examples of the preparation process will be explained below.

A starting polyketone and a solvent for dissolving the starting polyketone are charged in a dissolver and are stirred at a temperature higher than the phase separation temperature of the desired polyketone solution, preferably higher at least 30° C. than the phase separation temperature, whereby a substantially uniform polyketone solution can be obtained. When the stirring temperature is higher than 200° C., polyketone might be modified, and hence the stirring temperature is preferably not higher than 200° C., more preferably not higher than 120° C.

The polyketone solution is preferably defoamed for inhibiting the breakage of filaments. The defoaming can be attained when the polyketone solution is left to stand under reduced pressure or atmospheric pressure, but in the case of the viscosity of the polyketone solution being high, it requires a long time. Therefore, in this case, it is preferred to mix the starting polyketone with the solvent for dissolving the starting polyketone at a temperature lower than the phase separation temperature, preferably lower at least 30° C. than the phase separation temperature before the stirring and mixing step, followed by reducing the pressure with stirring. Since dissolution of the starting polyketone proceeds slowly, increase of the viscosity is inhibited and the defoaming is readily performed. However, if the temperature for mixing and stirring is −50° C. or lower, sometimes, the viscosity rather increases, and, hence, the temperature is preferably higher than −50° C. Subsequently to this defoaming step, stirring is carried out at a temperature higher than the phase separation temperature in the same manner as above under inhibiting the entry of air, thereby obtaining a substantially uniform polyketone solution free from foams.

Furthermore, a substantially uniform polyketone solution free from foams can also be obtained by charging a starting polyketone in a dissolver, adjusting the pressure therein to preferably not higher than 10 kPa, more preferably not higher than 1 kPa, pouring therein a solvent for dissolving the starting polyketone after defoamed, and stirring the content at a temperature higher than the phase separation temperature with inhibiting incorporation of air in the same manner as above. According to this process, defoaming of a polyketone solution having the further higher viscosity can be attained.

As the dissolvers, there may be used known ones which have a single-shaft or double-shaft stirring blade and are excellent in stirring efficiency. As the dissolvers of single-shaft stirring, suitable are those having a spiral or double-spiral blade. As batch type dissolvers of double-shaft stirring, there may be used, for example, planetary mixers using as the stirring blade a hook which revolves on its axis and round the shaft, double-arm type kneaders, Banbury mixer, etc. As continuous dissolvers of double-shaft stirring, there may be used, for example, screw extruders and cokneaders. Both of the dissolvers are preferably those types of high airtightness.

If necessary, the thus obtained polyketone solution is filtered by a filter to remove dusts, undissolved polymers, catalyst residues, etc. If necessary, antioxidants, light stabilizers, matting agents, etc. may be added to the polyketone solution.

Method for spinning the resulting polyketone solution will be explained below.

It is necessary that the temperature at which the polyketone solution is extruded from a spinneret is higher than the phase separation temperature. If it is lower than the phase separation temperature, the polyketone solution becomes non-uniform to cause occurrence of breakage of yarns or clogging of spinneret holes. Further, for the long term stability of extrusion, it is preferred to extrude the solution at a temperature higher at least 20° C. than the phase separation temperature. However, if the temperature is higher than 180° C., the extrusion sometimes becomes unstable due to the modification of polyketone, and thus the extrusion temperature is preferably not higher than 180° C. Furthermore, when the polyketone solution is extruded into a coagulating bath from the spinneret, in case the difference between the temperature of the polyketone solution and the temperature of the coagulating bath at the time of extrusion is great, it is preferred to employ a method in which the fibrous material discharged from the spinneret is introduced into the coagulating bath through air phase by placing the spinneret in the air, namely, so-called air-gap method.

In the present invention, the temperature at which the polyketone solution is extruded from the spinneret is more preferably 60–150° C., further preferably 60–100° C.

The temperature of the coagulating bath solution must be lower than the phase separation temperature. The polyketone solution extruded into a coagulating bath solution of a temperature lower than the phase separation temperature forms an entirely or partially gelling fibrous material. Such gelling fibrous material is inhibited from occurrence of defects during stretching, and, as a result, polyketone fibers having high strength and excellent fatigue resistance are obtained. The temperature of the coagulation bath solution is preferably lower at least 20° C. than the phase separation temperature, more preferably lower at least 30° C. than the phase separation temperature from the point of increasing the speed of formation of the gelling fibrous material to make it possible to increase the spinning speed. However, since if the temperature of the coagulating bath solution is lower than −50° C., the speed for the formation of the fibrous material rather decreases, and, furthermore, from the point of cost of cooling, the temperature of the coagulating bath solution is preferably not lower than −50° C.

The coagulating bath solution may be either high or low in solubility in the polyketone solution as far as it is liquid at the use temperature.

For example, when the solvent is an aqueous solution of metal salt, as the coagulating bath solutions of high solubility, mention may be made of organic solvents high in solubility in water, such as methanol, acetone, acetic acid, acetonitrile, pyridine, N, N-dimethylformamide, N, N-dimethylacetamide, N-methylpyrrolidone, etc., aqueous solutions mixed with these organic solvents, aqueous solutions in which are dissolved inorganic materials such as sulfuric acid, hydrochloric acid, phosphoric acid, metal salts, etc., water, and the like. In case these are used as the coagulating bath solution, since they are high in affinity with the solvent for dissolving the starting polyketone, a part of the solvent diffuses into the coagulating bath solution from the gelling fibrous material. Therefore, a part of the solvent has been removed from the fibrous material drawn out of the coagulating bath, and when heated, the fibrous material may again become a solution or only partially become a solution, or may not utterly become a solution. Because the fibrous material drawn out of the coagulating bath has high strength and the speed of spinning can be increased, the coagulating bath solution is preferably higher in solubility with the solvent and more preferably an aqueous solution containing at least 30% by weight of water. Especially, for the reduction of recovery cost of solvent, it is most preferred to use as a coagulating bath solution the solution containing the metal salts which is used as a solvent of the starting polyketone and in which the concentration of the metal salts is low enough not to dissolve the polyketone.

On the other hand, as the coagulation bath solution of low solubility, mention may be made of hydrocarbons such as pentane, hexane, heptane, octane, nonane, toluene, ethylbenzene, decalin, etc., halogenated hydrocarbons such as dichloromethane, dichloroethane, trichloroethane, chlorobenzene, 1,1-dichloro-1-fluoroethane, 1,1,2-trichloro-1,2,2-trifluoroethane, 2,2-dichloro-1,1,1-trifluoroethane, etc. When these are used as the coagulating bath solutions, since they are low in solubility in the polyketone solution, the solvent for dissolving the starting polyketone hardly diffuses into the bath from the gelling fibrous material. Therefore, the fibrous material drawn out of the coagulating bath has nearly the same composition as that of the polyketone solution when extruded, and again becomes solution upon heating.

The fibrous material which has passed through the coagulating bath is drawn out of the coagulating bath, and for obtaining polyketone fibers of high strength and high elastic modulus, it is preferred that the ratio of the speed of drawing the fibrous material out of the coagulating bath and the discharging lineal speed of discharging the dope from the spinneret holes, namely, the coagulation draft, is 0.2–2. The coagulation draft is more preferably 0.5–1.5, and further preferably 0.8–1.2. The coagulation draft is calculated in accordance with the following formula.

Coagulation draft=Speed of drawing out of coagulating bath (m/min)/Discharging lineal speed (m/min)

The fibrous material drawn out of the coagulating bath must be washed with a washing agent to remove a part or the whole of the solvent. As the washing agent, water or organic solvents such as methanol, ethanol, hexane, etc. can be used. Furthermore, if necessary, before or after the washing, the fibrous material can be washed with acidic solvents to remove the remaining metal salts, etc. As the acidic solvents, there may be used aqueous solutions containing acids such as hydrochloric acid, sulfuric acid, phosphoric acid, etc. The acid concentration in this case can be not less than 0.01% by weight, and in order to remove this acid, the fibrous material may be further washed with the above-mentioned washing agents after the acid washing. The temperature of the washing agent and the acidic solvent has no limitation, but is preferably not lower than 20° C., especially preferably 50–95° C. The washing methods include a method of passing the fibrous material through a bath containing the washing agent, a method of spraying the washing agent on the upper side and/or the lower side of the fibrous material, etc., and, of course, these methods may be used in combination.

The fibrous material from which a part or the whole of the solvent has been removed in this way is preferably heated and dried at a temperature of preferably not lower than 50° C. to remove a part or the whole of the solvent. The drying of the fibrous material may be carried out while stretching, keeping a constant length or shrinking. The drying temperature can be optionally set depending on the desired drying degree, and is usually 50–260° C., preferably 150–245° C. As the apparatuses for drying, there may be used known apparatuses such as a tunnel dryer, a roll dryer, a net process dryer, etc.

The drying draft at the drying is preferably 0.5–1.5 for obtaining polyketone fibers of high strength and high elastic modulus. In the present invention, the drying draft is more preferably 0.7–1.3, further preferably 0.7–1.2. The drying draft is a ratio of yarn speeds at the inlet and outlet of the dryer, and is calculated in accordance with the following formula.

Drying draft=Yarn speed at outlet of dryer (m/min)/Yarn speed at inlet of dryer (m/min)

For stretching of the polyketone fibers, preferred is a hot stretching method which comprises stretching the fibers with heating to a temperature higher than 100° C., and the stretching is carried out at one stage or multi-stages of two or more. For such hot stretching methods, known apparatuses or methods such as allowing the fibers to run on a heated roll or plate or through a heated gas, or irradiating the running fibers with laser beams, microwaves or far infrared rays can be employed as they are or as modified. From the viewpoints of heat transfer efficiency and uniformity of fiber temperature, the stretching on a heated roll or plate is preferred, and may be carried out using the roll and the plate in combination. Furthermore, when the circumference of the roll or the plate is enclosed and the enclosed space is filled with a heated gas, the stretching can be performed at more uniform temperatures and this method is preferred.

The stretching temperature is preferably 110–290° C., more preferably 200–280° C. In the case of carrying out the multi-stage stretching, preferred is a temperature-rising stretching in which the stretching temperature gradually rises with increase of the stretching ratio. Specific conditions for the temperature-rising stretching can be optionally selected depending on the stretching state, such as 220–250° C. for the first stage, 250–260° C. for the second stage, 260–265° C. for the third stage, and 265° C. to melting point for the fourth stage. Since the melting point of the polyketone fibers changes with the stretching ratio, it is preferred to determine the stretching temperature after the melting point is measured.

The stretching ratio is preferably not less than 5 times, more preferably not less than 10 times, especially preferably not less than 15 times in total stretching ratio.

The resulting polyketone fibers are preferably wound up at a tension of 0.005–0.5 cN/dtex after completion of the stretching. If the tension for winding up the polyketone fibers is less than 0.005 cN/dtex, there are problems that snagging of the fiber occurs at the treatments, variability of quality of the fibers is caused, and form of the packages becomes inferior. On the other hand, if the tension at the heat treatments exceeds 0.5 cN/dtex, a fresh residual stress is generated inside the fibers at the heat treatments and tight winding or heat shrinkage stress cannot be sufficiently restrained. The tension is preferably in the range of 0.01–0.3 cN/dtex.

The polyketone fibers stretched to a ratio of 10 times or more have a very high residual stress, and when they are wound up, a tight winding of package occurs or when they are exposed to heat during processing or use, a strong shrinkage stress is generated. Therefore, in order to restrain tight winding or generation of heat shrinkage stress in the polyketone fibers subjected to such a high stretching, it is preferred that after completion of the stretching, they are wound up under a tension of 0.005–0.5 cN/dtex after or under a heat treatment at preferably 100–280° C., especially preferably 150–250° C.

The polyketone fibers may be subjected to entangling treatment for the inhibition of fluffing caused by loosening of the fibers after the stretching step. The number of entanglement is 1–100/m, preferably 1–10/m.

At the above spinning step, in order to inhibit occurrence of friction between the fibers and the stretching machine and generation of static electricity to perform smooth stretching, it is preferred to apply a finishing agent to the fibers at one or more positions at optional stages of from drying to stretching.

The thus obtained polyketone fibers can be used as they are, or, if necessary, as finished yarns obtained by subjecting them to processing such as twisting, false twisting, bulky treatment, crimpping, winding, etc., and, furthermore, as fibrous articles such as knitted fabrics, woven fabrics, non-woven fabrics, etc. Particularly, twisted yarn articles (twist yarn cords) obtained by twisting the polyketone fibers of the present invention have excellent dimensional stability and are very useful in uses such as reinforcing materials exposed to heat at processing or in use, such as tires, belts, hoses, etc.

Kind and method of twisting and the number of fibers to be twisted are not particularly limited, and the kind of the twist yarns of the polyketone fibers of the present invention includes, for example, single twist yarns, plied yarns, plied yarns of different nature of strands, and hard twist yarns. The number of fibers to be twisted is also not limited, and the twist yarns may be any of those obtained by twisting one, two, three, four, or five fibers, or at least six fibers. In this case, they may be twisted together with fibers other than polyketone fibers, such as nylon fibers, PET fibers, aramid fibers, rayon fibers, etc.

The number of twisting has also no special limitation because it varies depending on single yarn fineness or total fineness, and may be optionally selected depending on the processing conditions and the environment of use. For example, in the case of twist yarn cords comprising polyketone multi-filaments having a single filament fineness of 0.01–10 dtex and a total fineness of 30–100000 dtex, those which are twisted with a twist coefficient K shown by the following formula in the range of 1000–30000 are preferred from the points of strength and fatigue resistance of fibers.

$$K=Y\times D^{0.5}\ (T/m\cdot dtex^{0.5})$$

In the above formula, Y denotes the number of twists per 1 m of the twist yarn cord (T/m), and D denotes a total fineness of the twist yarn cord (dtex). This total fineness is a sum of the fineness of all polyketone fibers used for the twist yarn. For example, when three polyketone fibers of 1660 dtex are twisted together, the total nominal fineness of the twisted yarn article is 4980 dtex (1660×3). If a plurality of polyketone fibers are twisted together by multi-stage twisting such as first twist and final twist, the twist coefficient K is calculated by assuming the number of the finally applied twisting to be the number of twist Y.

This polyketone twist yarn cord is treated with 10–30% by weight of resorcin-formalin-latex (hereinafter referred to as "RFL") solution, followed by applying a heat of at least 100° C. to adhere the RFL resin to the twist yarn cord, whereby a treated polyketone cord excellent in thermal characteristics can be obtained. The amount of the RFL resin applied to the polyketone twist yarn cord is preferably 2–7% by weight based on the weight of fibers. The composition of the RFL solution has no special limitation, and the RFL solution of known composition can be used as it is or with some modifications. Preferred composition of the RFL solution comprises 0.1–10% by weight of resorcin, 0.1–10% by weight of formalin, and 1–28% by weight of a latex, and more preferred comprises 0.5–3% by weight of resorcin, 0.5–3% by weight of formalin, and 10–25% by weight of a latex. The drying temperature of the RFL solution is preferably 120–250° C., more preferably 130–200° C., and desirably the treatment is carried out for at least 10 seconds, preferably 20–120 seconds. Desirably, the RFL-applied cord after dried is successively subjected to a heat treatment for a given period with maintaining the cord at a constant length. Conditions for the heat treatment are such that the treating temperature is preferably the maximum heat shrinkage temperature of the polyketone twist yarn cord±50° C., more preferably the maximum heat shrinkage temperature±10° C., most preferably the maximum heat shrinkage temperature±5° C., and the treating time is preferably 10–300 seconds, more preferably 30–120 seconds. During the heat treatment, the cord is preferably maintained at a constant length, and specifically the dimensional change before and after the heat treatment is preferably not more than 3%, more preferably not more than 1%, most preferably 0%.

DESCRIPTION OF PREFERRED EMBODIMENTS

The present invention will be explained in more detail by the following examples, etc., which never limit the scope of the present invention. The methods of measurement of the values used in the explanation of the examples are as shown below.

(1) Intrinsic Viscosity:

The intrinsic viscosity [72] of the starting polyketone and the polyketone fibers was obtained by the following definition formula.

$$[\eta] = \lim_{C \to 0} (T - t)/(t \cdot C)$$

In the above formula, t denotes a dropping time of hexafluoroisopropanol of at least 98% in purity through a viscosity tube at 25° C., T denotes a dropping time of a polyketone dilution solution dissolved in hexafluoroisopropanol of at least 98% in purity through a viscosity tube at 25° C., and C denotes the weight (gram unit) of the solute in 100 ml.

(2) Molecular Weight Distribution:

Polyketone was dissolved in a hexafluoroisopropanol solution containing 0.01N of sodium trifluoroacetate so that the polyketone concentration was 0.01% by weight, and measurement was conducted under the following conditions.

Device: SHIMADZU LC-10Advp

Column: The following columns were connected in the order of (1), (2) and (3).

(1): Shodex GPC HFIP-G (2): Shodex HFIP-606M (3): Shodex HFIP-606M

Column temperature: 40° C.

Mobile phase: A hexafluoroisopropanol solution containing 0.01N of sodium trifluoroacetate Flow rate: 0.5 ml/min Detector: Differential refractometer Pouring amount: 30 μl Polymethyl methacrylate (PMMA) having a monodisperse molecular weight distribution (concentration 0.01 wt %) was used as a standard sample, and from a calibration curve of the PMMA obtained under the same conditions as the above measuring conditions, a weight-average molecular weight (Mw) and a number-average molecular weight (Mn) of the measured polyketone in terms of PMMA were obtained, and Mw/Mn was employed as a molecular weight distribution.

(3) Amount of Palladium Element:

This was measured by high-frequency plasma emission spectrochemical analysis.

(4) Crystal Orientation:

A diffraction image of fibers was obtained under the following conditions using an imaging plate X-ray diffractometer RINT2000 manufactured by Rigaku K.K.

X-ray source: CuKα ray

Output: 40 KV 152 mA

Length of camera: 94.5 mm

Measuring time: 3 minutes

The (110) plane observed at around 2θ=21° of the image obtained was scanned in the circumferential direction, and from the half-width H of the resulting intensity distribution, the crystal orientation was calculated by the following formula.

$$\text{Crystal orientation } (\%) = \{(180 - H)/180\} \times 100$$

(5) Density:

Density of polyketone fibers was measured using a density gradient tube (heavy solution: carbon tetrachloride, light solution: n-heptane).

(6) Strength, Elongation, Elastic Modulus:

Strength, elongation and elastic modulus of polyketone fibers were measured in accordance with JIS-L-1013.

(7) Heat Shrinkage:

Polyketone fibers were subjected to a dry heat treatment at 150° C. for 30 minutes in an oven, and fiber length before and after the treatment was measured under application of a load (g) of the total fineness (dtex) of fibers×1/30, and the heat shrinkage was obtained by the following formula.

$$\text{Heat shrinkage } (\%) = \{(L_b - L_a)/L_b\} \times 100$$

In the above formula, $L_b$ denotes the fiber length before the heat treatment and $L_a$ denotes the fiber length after the heat treatment.

(8) Maximum Heat Shrinkage Stress:

The maximum heat shrinkage stress of the polyketone fibers under a constant displacement was measured under the following conditions using CORD-TESTER (Goodrich Type) manufactured by Toyo Seiki Mfg. Co., Ltd.

Temperature Program: EXP mode $^{\Theta}$M: 250° C.

$T_1$: 3 minutes

Initial load: 1/80 (cN/dtex)

Initial sample length: 250 mm

From the measured temperature-shrinking force curve, the maximum shrinking force $F_{max}$ (cN) was read, and the $F_{max}$ was divided by fineness (dtex) of the sample to obtain the maximum shrinkage stress $\sigma_{max}$ (cN/dtex)

(9) Coefficient of Dynamic Friction Between Fiber-Fiber:

Polyketone fibers A of about 690 m were wound round a cylinder at an angle of 15° under application of a tension of about 10 g. Furthermore, polyketone fibers B (kind: the same as the polyketone fibers A, length: 30.5 cm) were hung on the cylinder wound with the polyketone fibers A in parallel to the winding direction of the polyketone fibers A. A weight giving a load expressed by gram which was 0.1 time the total denier of the polyketone fibers B hung on the cylinder was attached to one end of the polyketone fibers B and a strain gauge was connected to another end. Then, the cylinder was rotated at a peripheral speed of 18 m/min, and tension was measured by the strain gauge. From the thus measured tension, the coefficient $\mu$ of dynamic friction between fiber-fiber was obtained in accordance with the following formula.

$$\mu=(1/\pi)\times\ln(T2/T1)$$

In the above formula, T1 denotes the weight of the weight attached to the fibers, T2 denotes the tension at the measurement, in denotes a natural logarithm, and $\pi$ denotes the ratio of the circumference of a circle to its diameter.

(10) Method for Making Twist Yarn Cord and Treated Cord and Evaluation on Physical Properties, and Evaluation on Fatigue Resistance of a Composite Material Made Using the Treated Cord as Reinforcing Fibers:

The resulting polyketone fibers were subjected to doubling to a total fineness of 1660 dtex. The resulting polyketone fibers were subjected to twisting at 390 T/m for both the final and first twists (twist coefficient: 22500) to make a twist yarn cord, and then thereto was applied a resorcin-formalin-latex solution (resorcin: 22 parts by weight, 30 wt % aqueous formalin solution: 30 parts by weight, 10 wt % aqueous sodium hydroxide solution: 14 parts by weight, water: 570 parts by weight, vinylpyridine latex: 41 parts by weight) to obtain an RFL-treated cord (dip cord). Strength of the twist yarn cord, and strength and heat shrinkage of the treated cord were measured by the above-mentioned methods.

Further, the resulting treated cords were disposed at 25 cords/inch as the two upper and lower layers in an unvulcanized rubber comprising 70% by weight of natural rubber, 15% by weight of SBR and 15% by weight of carbon black, followed by carrying out vulcanization (vulcanization conditions: 135° C., 35 kg/cm$^2$, 40 minutes) to obtain a belt of 8 mm in thick. This belt was subjected to compression-bending fatigue test in accordance with JIS-L1017–2.1 (Firestone method) (load: 50 kg, belt running speed: 100 rpm, the number of tests: 20000 times, compression ratio: 85%). After the tests, the cord on the compressed side was taken out and evaluated on fatigue resistance from the strength retention rate (%) with respect to the cord before subjected to the fatigue test.

REFERENCE EXAMPLE 1

In an autoclave of 55 liters was charged 27 liters of methanol, and thereto was further added a catalyst solution prepared previously by stirring 1.8 millimoles of palladium acetate, 2.2 millimoles of 1,3-bis(di(2-methoxyphenyl) phosphino)propane and 36 millimoles of trifluoroacetic acid in 1 liter of acetone. Thereafter, the autoclave was filled with a mixed gas comprising carbon monoxide and ethylene at a molar ratio of 1:1, and reaction was carried out at 80° C. for 5 hours while continuously adding this mixed gas so as to maintain a pressure of 5 MPa.

After termination of the reaction, the pressure was liberated, and the resulting white polymer was repeatedly washed with heated methanol, 1,3-pentanedione and then isolated. The yield was 5.4 kg. The resulting polyketone was found to be poly(1-oxotrimethylene) by the analyses such as nuclear magnetic resonance spectrum, infrared absorption spectrum, etc. Moreover, the molecular weight distribution was 3.0, the intrinsic viscosity was 5.0 dl/g, and the Pd content was 30 ppm.

REFERENCE EXAMPLE 2

In an autoclave of 55 liters was charged 27 liters of methanol, and thereto was further added a catalyst solution prepared previously by stirring 2.0 millimoles of palladium acetate, 2.4 millimoles of 1,3-bis(diphenylphosphino) propane and 40 millimoles of trifluoroacetic acid in 1 liter of acetone. Thereafter, the autoclave was filled with a mixed gas comprising carbon monoxide and ethylene at a molar ratio of 1:1, and reaction was carried out at 55° C. for 15 hours while continuously adding this mixed gas so as to maintain a pressure of 5 MPa.

After termination of the reaction, the pressure was liberated, and the resulting white polymer was repeatedly washed with cold methanol and then isolated. The yield was 3.9 kg. The resulting polyketone was found to be poly(1-oxotrimethylene) by the analyses such as nuclear magnetic resonance spectrum, infrared absorption spectrum, etc. Moreover, the molecular weight distribution was 6.2, the intrinsic viscosity was 5.0 dl/g, and the Pd content was 52 ppm.

EXAMPLE 1

An aqueous solution containing zinc chloride and calcium chloride (weight ratio of zinc chloride/calcium chloride: 35.5/64.5, concentration of metal salts: 62% by weight) was mixed with the polyketone obtained in Reference Example 1 at 30° C. so that the concentration of the polyketone was 7.5% by weight, followed by reducing the pressure to 1.3 kPa. After generation of bubbles ceased, the dissolver was closed under the reduced pressure, followed by stirring at 85° C. for 2 hours to obtain a uniform and transparent polyketone solution. This polyketone solution had a phase separation temperature of 35° C. The resulting polyketone solution was passed through a filter of 20 $\mu$m, then extruded from a spinneret having 50 holes of 0.15 mm in diameter at 80° C. and at a rate of 5 m/min using a plunger extruder, passed through an air gap of 10 mm in length, passed as it was through a coagulating bath (coagulation solution: water of 2° C.), and then drawn out of the coagulating bath at a rate of 6 m/min using a first Nelson roll (coagulation draft=1.2). Then, the coagulated solution was washed by spraying with water on the first Nelson roll, further passed through a 1% hydrochloric acid bath, drawn out of the coagulating bath at a rate of 6 m/min using a second Nelson roll, then washed by spraying with water on the second Nelson roll, dried by passing on a hot plate of 220° C., and then wound up at 5.4 m/min (drying draft=0.9). The resulting fibers were subjected to four-stage stretching at 225° C., 240° C., 250° C., and 257° C. with gradually raising the temperature, followed by applying to the fibers 1.5% by weight of a finishing agent (sorbitan oleate/10 moles polyethylene oxide-added castor oil ester/bisphenol A laurate/polyethylene oxide-cured castor oil maleate/polyether (propylene oxide/ethylene oxide=35/65: molecular weight 20000)/sodium stearylsulfonate/sodium dioctylphosphate=30/30/20/13/5/1/1(weight ratio)) and then winding up the fibers at a tension of 0.1 cN/dtex to obtain polyketone fibers. Physical properties of the polyketone fibers are shown in Table 1. Furthermore, a section of the fibers was observed by a light microscope and a scanning microscope to find a uniform structure with no skin-core structure. The fibers were high in strength and elastic modulus and excellent in heat resistance, dimensional stability, fatigue resistance and processability. The fibers had a Pd content of 25 ppm and a Zn content of 10 ppm.

EXAMPLE 2

An aqueous solution of zinc chloride and calcium chloride (the weight ratio of zinc chloride/calcium chloride: 35.5/64.5, the concentration of metal salts: 62% by weight) was mixed with poly(1-oxotrimethylene) having a molecular weight distribution of 1.5, an intrinsic viscosity of 7.0 dl/g and a Pd residue of 5 ppm at 30° C. so that the concentration of the poly(1-oxotrimethylene) was 6.5% by weight, followed by reducing the pressure to 1.3 kPa. After generation of bubbles ceased, the dissolver was closed under the reduced pressure, followed by stirring the content at 85° C. for 2 hours to obtain a uniform and transparent polyketone solution. This polyketone solution had a phase separation temperature of 30° C. The resulting polyketone solution was passed through a filter of 20 μm, then extruded from a spinneret having 50 holes of 0.15 mm in diameter at 85° C. and at a rate of 5 m/min using a plunger extruder, passed through an air gap of 10 mm in length, then passed as it was through a coagulating bath (coagulation solution: water of 2° C.), and thereafter drawn out of the coagulating bath at a rate of 5 m/min using a first Nelson roll (coagulation draft=1.0). Then, the coagulated solution was washed by spraying with water on the first Nelson roll, further passed through a 1% hydrochloric acid bath, drawn out of the coagulating bath at a rate of 5 m/min using a second Nelson roll, then washed by spraying with water on the second Nelson roll, dried by passing on a hot plate of 220° C., and then wound up at 5 m/min (drying draft=1.0). The resulting fibers were subjected to four-stage stretching of 7.5 times at 225° C., 1.5 time at 240° C., 1.4 time at 250° C., and 1.35 time at 257° C. (total hot stretching ratio=21.3), followed by applying to the fibers 1.6% by weight of the finishing agent of Example 1 and then winding up the fibers at a tension of 0.1 cN/dtex to obtain polyketone fibers. Physical properties of the polyketone fibers are shown in Table 1. Furthermore, a section of the fibers was observed by a light microscope and a scanning microscope to find a uniform structure with no skin-core structure. The fibers were high in strength and modulus and excellent in heat resistance, dimensional stability, fatigue resistance and processability. The fibers had a Pd content of 25 ppm and a Zn content of 10 ppm.

EXAMPLE 3

Polyketone fibers were obtained under the same conditions as in Example 2, except that the weight ratio of zinc chloride/calcium chloride was 38.0/62.0. The polyketone solution had a phase separation temperature of 12° C. Physical properties of the resulting polyketone fibers are shown in Table 1. Furthermore, a section of the fibers was observed by a light microscope and a scanning microscope to find a uniform structure with no skin-core structure. The fibers were high in strength and modulus and excellent in heat resistance, dimensional stability, fatigue resistance and processability. The fibers had a Pd content of 25 ppm and a Zn content of 10 ppm.

EXAMPLE 4

Polyketone fibers were obtained under the same conditions as in Example 2, except that the coagulating bath was an aqueous solution of zinc chloride and calcium chloride (the weight ratio of zinc chloride/calcium chloride: 35.5/64.5, the concentration of metal salts: 62% by weight), a 10% by weight aqueous solution of zinc chloride and calcium chloride (the ratio of the metal salts was the same as of the solvent) was used as the coagulating bath solution, and the temperature of the coagulating bath solution was −3° C. A section of the fibers was observed by a light microscope and a scanning microscope to find a uniform structure with no skin-core structure. The fibers were high in strength and modulus and excellent in heat resistance, dimensional stability, fatigue resistance and processability. The fibers had a Pd content of 25 ppm and a Zn content of 10 ppm.

EXAMPLE 5

An aqueous solution containing zinc chloride, calcium chloride and lithium chloride (the weight ratio of zinc chloride/calcium chloride/lithium chloride: 35.5/48.4/16.1, the concentration of the metal salts: 62% by weight) was mixed with the polyketone obtained in Reference Example 1 at 30° C. so that the concentration of the polyketone was 7.5% by weight, followed by reducing the pressure to 1.3 kPa. After generation of bubbles ceased, the dissolver was closed under the reduced pressure, followed by stirring the content at 85° C. for 2 hours to obtain a uniform and transparent polyketone solution. This polyketone solution had a phase separation temperature of 47° C. The resulting polyketone solution was passed through a filter of 20 μm, then extruded from a spinneret having 50 holes of 0.15 mm in diameter at 80° C. and at a rate of 5 m/min using a plunger extruder, passed through an air gap of 10 mm in length, then passed as it was through a coagulating bath (coagulating bath solution: water of 2° C.), and then drawn out of the coagulating bath at a rate of 6 m/min using a first Nelson roll (coagulation draft=1.2). Then, the coagulated solution was washed by spraying with water on the first Nelson roll, further passed through a 1% hydrochloric acid bath, drawn out of the coagulating bath at a rate of 6 m/min using a second Nelson roll, then washed by spraying with water on the second Nelson roll, dried by passing on a hot plate of 220° C., and then wound up at 5.4 m/min (drying draft=0.9). The resulting fibers were subjected to the same four-stage stretching as in Example 1 and then wound up at a tension of 0.1 cN/dtex to obtain polyketone fibers. Physical properties of the polyketone fibers are shown in Table 1. Furthermore, a section of the fibers was observed by a light microscope and a scanning microscope to find a uniform structure with no skin-core structure. The fibers were high in strength and modulus and excellent in heat resistance, dimensional stability, fatigue resistance and processability. The fibers had a Pd content of 23 ppm and a Zn content of 7 ppm.

EXAMPLE 6

An aqueous solution containing zinc chloride, calcium chloride and calcium thiocyanate (the weight ratio of zinc chloride/calcium chloride/calcium thiocyanate: 35.5/61.3/3.2, the concentration of the metal salts: 62% by weight) was mixed with the polyketone obtained in Reference Example 1 at 30° C. so that the concentration of the polyketone was 7.5% by weight, followed by reducing the pressure to 1.3 kPa. After generation of bubbles ceased, the dissolver was closed under the reduced pressure, followed by stirring at 85° C. for 2 hours to obtain a uniform and transparent polyketone solution. This polyketone solution had a phase separation temperature of 43° C. The resulting polyketone solution was passed through a filter of 20 μm, then extruded from a spinneret having 50 holes of 0.15 mm in diameter at 80° C. and at a rate of 5 m/min using a plunger extruder, passed through an air gap of 10 mm in length, then passed as it was through a coagulating bath (coagulating bath solution: water of 2° C.), and then drawn out of the coagulating bath at a rate of 6 m/min using a first Nelson roll (coagulation draft=1.2). Then, the coagulated solution was washed by spraying with water on the first Nelson roll, further passed through a 1% hydrochloric acid bath, drawn out of the coagulating bath at a rate of 6 m/min using a second Nelson roll, then washed by spraying with water on the second Nelson roll, dried by passing on a hot plate of 220° C., and then wound up at 5.4 m/min (drying draft=0.9). The resulting fibers were subjected to the same four-stage stretching as in Example 1 and then wound up at a tension of 0.1 cN/dtex to obtain polyketone fibers. Physical properties of the polyketone fibers are shown in Table 1. Furthermore, a section of the fibers was observed by a light microscope and a scanning microscope to find a uniform structure with no skin-core structure. The fibers were high in strength and elastic modulus and excellent in heat resistance, dimensional stability, fatigue resistance and processability. The fibers had a Pd content of 25 ppm and a Zn content of 6 ppm.

EXAMPLE 7

Polyketone fibers were obtained under the same conditions as in Example 1, except that the fibers before winding up were heat treated using a hot plate of 200° C. at a tension of 0.03 cN/dtex and then wound up to obtain polyketone fibers. Physical properties of the resulting polyketone fibers are shown in Table 1. The heat shrinkage and the maximum heat shrinkage stress of the resulting stretched yarns further lowered, and the dimensional stability was further improved. The fibers had a Pd content of 25 ppm and a Zn content of 10 ppm.

COMPARATIVE EXAMPLE 1

An aqueous solution of zinc chloride and calcium chloride (the weight ratio of zinc chloride/calcium chloride: 86.7/13.3, the concentration of the metal salts: 75% by weight) was mixed with the polyketone obtained in Reference Example 1 at 30° C. so that the concentration of the polyketone was 5.0% by weight, followed by reducing the pressure to 1.3 kPa. After generation of bubbles ceased, the dissolver was closed under the reduced pressure, followed by stirring at 85° C. for 2 hours to obtain a uniform and transparent polyketone solution. Even when this polyketone solution was cooled to −5° C., no phase separation temperature was observed, and the solution remained uniform. Using the resulting polyketone solution, polyketone fibers were obtained in the same manner as in Example 1. Physical properties of the polyketone fibers are shown in Table 2. A section of the fibers was observed by a light microscope and a scanning microscope to find that there was a skin-core structure, and fine voids were present inside the fibers. Furthermore, when they were twisted, they showed much fluffing and were insufficient in fatigue resistance.

COMPARATIVE EXAMPLE 2

Polyketone fibers were obtained in the same manner as in Example 1, except that the polyketone of Reference Example 2 was used in place of the polyketone of Reference Example 1. The polyketone solution colored much, and even when it was cooled to lower than −3° C., it hardly solidified in the form of a gel, and phase separation temperature could not be determined. Physical properties of the polyketone fibers are shown in Table 2. A section of the fibers was observed by a light microscope and a scanning microscope to find that they had a skin-core structure, and fine voids were present inside the fibers. Furthermore, when they were twisted, they showed much fluffing and were insufficient in fatigue resistance. The fibers had a Pd content of 51 ppm and a Zn content of 10 ppm.

COMPARATIVE EXAMPLE 3

Polyketone fibers were obtained in the same manner as in Example 1, except that the polyketone solution of Example 1 was heated to 100° C., and extruded into a coagulating bath of 50° C., which was higher than the phase separation temperature. Physical properties of the resulting polyketone fibers are shown in Table 2. A section of the fibers was observed by a light microscope and a scanning microscope to find that they had a skin-core structure, and fine voids were present inside the fibers. Furthermore, when they were twisted, they showed much fluffing and were insufficient in fatigue resistance.

COMPARATIVE EXAMPLE 4

An aqueous solution of zinc chloride of 75% by weight in metal salt concentration was mixed with the polyketone obtained in Reference Example 1 at 30° C. so that the concentration of the polyketone was 7.5% by weight, followed by reducing the pressure to 1.3 kPa. After generation of bubbles ceased, the dissolver was closed under the reduced pressure, followed by stirring at 85° C. for 2 hours to obtain a uniform and transparent polyketone solution. Even when this polyketone solution was cooled to −5° C., no phase separation temperature was observed, and the solution remained uniform. Using the resulting polyketone solution, spinning experiments were conducted in the same manner as in Example 1. Physical properties of the resulting polyketone fibers are shown in Table 2. A section of the fibers was observed by a light microscope and a scanning microscope to find that they had a skin-core structure, and fine voids were present inside the fibers. Furthermore, when they were twisted, they showed much fluffing and were insufficient in fatigue resistance.

COMPARATIVE EXAMPLE 5

Hexafluoroisopropanol was mixed with the polyketone of Reference Example 1 at 25° C. so that the concentration of the polyketone was 6.5% by weight, followed by reducing the pressure to 1.3 kPa. After generation of bubbles ceased, the dissolver was closed under the reduced pressure, followed by stirring at 50° C. for 2 hours to obtain a uniform and transparent polyketone solution. Even when this polyketone solution was cooled to −5° C., no phase separation temperature was observed, and the solution remained uniform. The polyketone solution was extruded into a coagulating bath (coagulation bath solution: acetone of 25° C.), and polyketone fibers were obtained in the same manner as in Example 1. Physical properties of the resulting polyketone fibers are shown in Table 2. A section of the fibers was observed by a light microscope and a scanning microscope to find that they had a skin-core structure, and fine voids were present inside the fibers. Furthermore, when they were twisted, they showed much fluffing and were insufficient in fatigue resistance.

EXAMPLE 8

The polyketone fibers of 1500 dtex/750 f obtained by the method of Example 1 were twisted together at 390 T/m for both the first and final twisting to obtain a twist yarn cord. This twist yarn cord was treated with 20% by weight of RFL and passed through dryers of 130° C. and 225° C. so as to give a resin application of 5% by weight. A radial tire was produced using the resulting treated cord as a tire cord.

The resulting radial tire was subjected to a rotation test of 96 hours which comprises allowing the tire to contact with an asphalt surface of 35° C. under application of the same contact pressure as applied when a passenger car of 1 t runs at 200 km/hr on an asphalt surface and rotating the tire at the same number of rotation as the number of rotation when the passenger car runs at 200 km/hr on the asphalt surface.

After the test for 96 hours, the tire cord was removed from the tire and the strength retention rate was measured. When the polyketone fibers of Example 1 were used, the strength hardly reduced as compared with the strength of the tire cord after subjected to the RFL treatment. For comparison, the same experiment was conducted using the polyketone fibers of Comparative Example 5, and, as a result, the strength of the tire cord after the experiment reduced about 12%.

EXAMPLE 9

The fibers of 1500 dtex/750 f obtained by the method of Example 1 were cut to short fibers of 50 mm. Two parts of the short fibers, 3 parts of a pulp, 57 parts of Portland cement and 38 parts of silica were mixed, and the mixture was subjected to wet paper making and then subjected to forming at 120° C. in an autoclave to make a slate plate. The resulting slate plate was excellent in strength, and the section was observed to find that the polyketone fibers were uniformly dispersed. When solution viscosity of the polyketone fibers taken out of the slate plate was measured, reduction of the viscosity was not seen. For comparison, the same experiment was conducted using the polyketone fibers of Comparative Example 5, and, as a result, the viscosity of the polyketone fibers after the experiment reduced about 6%. It seems that the reduction of the viscosity occurred at the stage of forming in the autoclave.

EXAMPLE 10

The polyketone fibers of 1500 dtex/750 f obtained by the method of Example 1 were twisted together at 390 T/m for both the first and final twisting to obtain a twist yarn cord. This twist yarn cord was treated with an epoxy resin and passed through a dryer of 230° C. so as to give a resin application of 5% by weight. A B-type cogged V-belt of 1016 mm in length composed of a top canvas, a compressed rubber layer comprising chloroprene rubber, and a bottom canvas was produced using the resulting treated cord by a conventional method. This V-belt was put between two pulleys and rotated at 2000 rpm for 24 hours. After the test, the polyketone fibers were taken out from the V-belt, and strength of the fibers was measured to find that the strength hardly reduced as compared with the strength of the fibers after the epoxy treatment. For comparison, the same experiment was conducted using the polyketone fibers of Comparative Example 5, and, as a result, the strength of the polyketone fibers after the test reduced about 7%.

TABLE 1

| | Example 1 | Example 2 | Example 3 | Example 4 | Example 5 | Example 6 | Example 7 |
|---|---|---|---|---|---|---|---|
| Solvent | $ZnCl_2/CaCl_2$ Aqueous solution | $ZnCl_2/CaCl_2$ Aqueous solution | $ZnCl_2/CaCl_2$ Aqueous solution | $ZnCl_2/CaCl_2$ Aqueous solution | $ZnCl_2/CaCl_2/LiCl$ Aqueous solution | $ZnCl_2/CaCl_2/Ca(SCN)_2$ Aqueous solution | $ZnCl_2/CaCl_2$ Aqueous solution |
| Weight ratio of metal salts | $ZnCl_2/CaCl_2$ 35.5/64.5 | $ZnCl_2/CaCl_2$ 35.5/64.5 | $ZnCl_2/CaCl_2$ 38.0/62.0 | $ZnCl_2/CaCl_2$ 35.5/64.5 | $ZnCl_2/CaCl_2/LiCl$ 35.5/48.4/16.1 | $ZnCl_2/CaCl_2/Ca(SCN)_2$ 35.5/61.3/3.2 | $ZnCl_2/CaCl_2$ 35.5/64.5 |
| Concentration of metal salts (wt %) | 62 | 62 | 62 | 62 | 62 | 62 | 62 |
| Intrinsic viscosity of polyketone (dl/g) | 5.0 | 7.0 | 7.0 | 7.0 | 5.0 | 5.0 | 5.0 |
| Molecular weight distribution of polyketone | 3.0 | 1.5 | 1.5 | 1.5 | 3.0 | 3.0 | 3.0 |
| Pd content in polyketone (ppm) | 30 | 5 | 5 | 5 | 30 | 30 | 30 |
| Concentration of polyketone (wt %) | 7.5 | 6.5 | 6.5 | 6.5 | 7.5 | 7.5 | 7.5 |
| Phase separation temperature (° C.) | 35 | 30 | 12 | 30 | 47 | 43 | 35 |
| Extrusion temperature (° C.) | 80 | 85 | 85 | 85 | 80 | 80 | 80 |
| Temperature of coagulating bath solution (° C.) | 2 | 2 | 2 | −3 | 2 | 2 | 2 |
| Coagulation draft | 1.2 | 1.0 | 1.0 | 1.0 | 1.2 | 1.2 | 1.2 |
| Drying draft | 0.9 | 1.0 | 1.0 | 1.0 | 0.9 | 0.9 | 0.9 |
| Tension before winding up (cN/dtex) | 0.1 | 0.1 | 0.1 | 0.1 | 0.1 | 0.1 | 0.03 |
| Physical properties of polyketone fibers | | | | | | | |
| Intrinsic viscosity of fibers (dl/g) | 3.0 | 3.2 | 3.1 | 3.1 | 3.0 | 2.9 | 2.9 |
| Crystal orientation (%) | 97 | 97 | 98 | 97 | 98 | 97 | 95 |

TABLE 1-continued

| | Example 1 | Example 2 | Example 3 | Example 4 | Example 5 | Example 6 | Example 7 |
|---|---|---|---|---|---|---|---|
| Density (g/cm$^3$) | 1.323 | 1.324 | 1.322 | 1.324 | 1.323 | 1.322 | 1.322 |
| Heat shrinkage (%) | 1.5 | 1.8 | 1.6 | 1.9 | 1.8 | 1.7 | 0.5 |
| Maximum heat shrinkage stress (cN/dtex) | 0.61 | 0.62 | 0.67 | 0.69 | 0.70 | 0.65 | 0.21 |
| Fineness (dtex) | 61.1 | 53.3 | 54.4 | 54.4 | 60.7 | 60.8 | 60.9 |
| Strength (cN/dtex) | 17.9 | 18.7 | 18.0 | 19.5 | 19.7 | 19.0 | 18.1 |
| Elongation (%) | 4.9 | 5.1 | 5.0 | 4.6 | 4.6 | 5.3 | 5.1 |
| Elastic modulus (cN/dtex) | 467 | 469 | 454 | 485 | 476 | 478 | 467 |
| Sticking ratio of single filaments (%) | 2 | 4 | 12 | 6 | 6 | 0 | 6 |
| Oiling agent application amount (%) | 1.5 | 1.6 | 1.5 | 1.6 | 1.5 | 1.8 | 1.5 |
| Coefficient of dynamic friction between fiber-fiber | 2.1 | 1.9 | 2.3 | 2.2 | 2.4 | 1.6 | 2.5 |
| Physical properties of twist yarn cord and treated cord | | | | | | | |
| Strength of twist yarn cord (cN/dtex) | 13.4 | 13.7 | 12.6 | 14.0 | 14.9 | 14.8 | 13.4 |
| Strength of treated cord (cN/dtex) | 13.7 | 13.9 | 12.7 | 14.1 | 15.0 | 14.8 | 13.3 |
| Heat shrinkage of treated cord (%) | 0.5 | 0.4 | 0.5 | 0.5 | 0.4 | 0.6 | 0.3 |
| Strength retention rate (%) | 60 | 61 | 59 | 63 | 61 | 61 | 62 |

TABLE 2

| | Comparative Example 1 | Comparative Example 2 | Comparative Example 3 | Comparative Example 4 | Comparative Example 5 |
|---|---|---|---|---|---|
| Solvent | $ZnCl_2/CaCl_2$ Aqueus solution | $ZnCl_2/CaCl_2$ Aqueous solution | $ZnCl_2/CaCl_2$ Aqueous solution | $ZnCl_2$ Aqueous solution | $(CF_3)_2CH_2OH$ |
| Weight ratio of metal salts | $ZnCl_2/CaCl_2$ 86.7/13.3 | $ZnCl_2/CaCl_2$ 35.5/64.5 | $ZnCl_2/CaCl_2$ 35.5/64.5 | — — | — — |
| Concentration of metal salts (wt %) | 75 | 62 | 62 | 75 | — |
| Intrinsic viscosity of polyketone (dl/g) | 5.0 | 5.0 | 5.0 | 5.0 | 5.0 |
| Molecular weight distribition of polyketone | 3.0 | 6.2 | 3.0 | 3.0 | 3.0 |
| Pd content in polyketone (ppm) | 30 | 52 | 30 | 30 | 30 |
| Concentration of polyketone (wt %) | 7.5 | 7.5 | 7.5 | 7.5 | 6.5 |
| Phase separation temperature (° C.) | No | Indefinite | 35 | No | No |
| Extrusion temperature (° C.) | 80 | 80 | 100 | 80 | 25 |
| Temperature of coagulating bath solution (° C.) | 2 | 2 | 85 | 25 | 25 |
| Coagulation draft | 1.2 | 1.2 | 1.2 | 1.2 | 1.2 |
| Drying draft | 0.9 | 0.9 | 0.9 | 0.9 | 0.9 |
| Tension before winding up (cN/dtex) | 0.1 | 0.1 | 0.1 | 0.1 | 0.1 |
| Physical properties of polyketone fibers | | | | | |
| Intrinsic viscosity of fibers (dl/g) | 2.7 | 2.8 | 3.1 | 3.2 | 3.4 |
| Crystal orientation (%) | 95 | 95 | 95 | 95 | 95 |
| Density (g/cm$^3$) | 1.292 | 1.293 | 1.292 | 1.274 | 1.256 |
| Heat shrinkage (%) | 3.1 | 3.1 | 3.2 | 3.1 | 3.2 |
| Maximum heat shrinkage stress (cN/dtex) | 0.81 | 0.84 | 0.91 | 0.8 | 0.8 |
| Fineness (dtex) | 70.2 | 70.5 | 70.2 | 71 | 75 |
| Strength (cN/dtex) | 12.3 | 14.7 | 14.5 | 13.2 | 9.2 |
| Elongation (%) | 5.0 | 4.8 | 4.9 | 4.8 | 5.0 |
| Elastic modulus (cN/dtex) | 290 | 270 | 290 | 270 | 240 |
| Sticking ratio of single filaments (%) | 26 | 80 | 6 | 34 | 2 |
| Oiling agent application amount (%) | 1.6 | 1.6 | 1.6 | 1.5 | 1.4 |
| Coefficient of dynamic friction between fiber-fiber | 2.2 | 2.4 | 2.2 | 2.2 | 2.1 |
| Physical properties of twist yarn cord and treated cord | | | | | |
| Strength of twist yarn cord (cN/dtex) | 7.9 | 10.5 | 10.6 | 8.2 | 6.4 |
| Strength of treated cord (cN/dtex) | 8.0 | 10.4 | 10.6 | 8.1 | 6.4 |
| Heat shrinkage of treated cord (%) | 0.6 | 0.5 | 0.5 | 1.1 | 1.2 |
| Strength retention rate (%) | 48 | 51 | 50 | 50 | 42 |

The polyketone fibers of the present invention are high in strength and elastic modulus, and excellent in fatigue resistance, processability, heat resistance, dimensional stability, and, besides, adhesion. Therefore, the polyketone fibers of the present invention as they are or as polyketone fiber cords or as processed to fibrous articles can be applied to various uses such as clothing use, industrial use, subsistence goods, etc. Particularly, the polyketone fibers of the present invention can be widely used for rubber reinforcing materials such as tire cords, hoses, belts, etc., concrete reinforcing materials, nonwoven fabrics such as tension member filters of optical fibers, house lap, etc., woven fabrics such as air bags, sheets, etc., knitted fabrics such as fishing nets, etc., industrial materials such as fishing lines, sewing yarns, ropes, etc., fibers for clothing such as women's clothing, sports wears, uniforms, working cloth, etc., daily commodities, etc.

What is claimed is:

1. A polyketone solution which comprises a poly ketone containing a ketone unit represented by the following formula (1) as a main repeating unit and having a molecular weight distribution of 1–6 and a Pd content of not more than 50 ppm and a solvent for dissolving the polyketone and which has a phase separation temperature in the range of 0–150° C.:

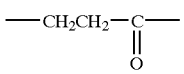

(1)

wherein the solvent for dissolving the polyketone is an aqueous solution containing zinc chloride and calcium chloride, the weight ratio of zinc chloride and calcium chloride is 29/71–44/56, and the total concentration of the zinc chloride and calcium chloride in the solution is 58–64% by weight.

2. A polyketone solution which comprises a polyketone containing a ketone unit represented by the following formula (1) as a main repeating unit and having a molecular weight distribution of 1–6 and a Pd content of not more than 50 ppm and a solvent for dissolving the polyketone and which has a phase separation temperature in the range of 0–150° C.:

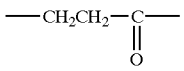

(1)

wherein the solvent for dissolving the polyketone is an aqueous solution containing zinc chloride, calcium chloride and lithium chloride, the weight ratio of zinc chloride and the total of calcium chloride and lithium chloride is 29/71–44/56, the weight ratio of calcium chloride and lithium chloride is 49/51–91/9, and total concentration of the zinc chloride, calcium chloride and lithium chloride in the solution is 58–64% by weight.

3. A polyketone solution which comprises a polyketone containing a ketone unit represented by the following formula (1) as a main repeating unit and having a molecular weight distribution of 1–6 and a Pd content of not more than 50 ppm and a solvent for dissolving the polyketone and which has a phase separation temperature in the range of 0–150° C.:

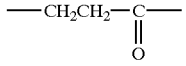

(1)

wherein the solvent for dissolving the polyketone is an aqueous solution containing zinc chloride, calcium chloride and calcium thiocyanate, the weight ratio of zinc chloride and the total of calcium chloride and calcium thiocyanate is 29/71–44/56, the weight ratio of calcium chloride and calcium thiocyanate is 76/24–99.5/0.5, and the total concentration of the zinc chloride, calcium chloride and calcium thiocyanate in the solution is 58–64% by weight.

4. A polyketone solution which comprises a polyketone containing a ketone unit represented by the following formula (1) as a main repeating unit and having a molecular weight distribution of 1–6 and a Pd content of not more than 50 ppm and a solvent for dissolving the polyketone and which has a phase separation temperature in the range of 0–150° C.:

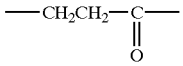

(1)

wherein the solvent for dissolving the polyketone is an aqueous solution containing zinc chloride and calcium thiocyanate, the weight ratio zinc chloride and calcium thiocyanate is 32/68–49/51, and the total concentration the zinc chloride and calcium thiocyanate in the solution is 57–65% by weight.

5. A polyketone solution according to any one claims 1–4, wherein the polyketone concentration is 1–40% by weight.

6. A process for producing polyketone fibers which comprises heating the polyketone solution of any one of claims 1–4 to a temperature higher than the phase separation temperature, then extruding the polyketone solution into a coagulating bath having a temperature lower than the phase separation temperature to form a fibrous material, thereafter removing a part or the whole of the solvent which dissolves the polyketone from the fibrous material, stretching the fibrous material and winding up the resulting fibrous material.

7. A process for producing polyketone fibers according to claim 6, wherein after completion of the stretching, the fibers are wound up at a tension of 0.005–0.5 cN/dtex.

8. A process for producing polyketone fibers according to claim 6, wherein the fibers obtained after stretching are wound up at a tension of 0.005–0.5 cN/dtex after or while heat treating the fibers at 100–280° C.

9. A process for producing polyketone, fibers which comprises heating the polyketone solution of any one of claims 1–4 to a temperature higher than the phase separation temperature, then extruding the polyketone solution into a coagulating bath having a temperature lower than the phase separation temperature to form a fibrous material, thereafter drawing the fibrous material out of the coagulating bath at a coagulation draft of 0.2–2, successively drying the fibrous material at a drying draft of 0.5–1.5 after or while removing a part or the whole of the solvent which dissolves the polyketone from the fibrous material, stretching the fibrous material and winding up the resulting fibrous material.

10. A process for producing polyketone fibers according to claim 9, wherein after completion of the stretching, the fibers are wound up at a tension of 0.005–0.5 cN/dtex.

11. A process for producing polyketone fibers according to claim 9, wherein the fibers obtained after stretching are wound up at a tension of 0.005–0.5 cN/dtex after or while heat treating the fibers at 100–280° C.

* * * * *

UNITED STATES PATENT AND TRADEMARK OFFICE

CERTIFICATE OF CORRECTION

PATENT NO. : 6,818,728 B2
DATED : November 16, 2004
INVENTOR(S) : Junichiro Kato et al.

It is certified that error appears in the above-identified patent and that said Letters Patent is hereby corrected as shown below:

Column 29,
Line 9, “poly ketone” should read -- polyketone --.
Line 45, “and total” should read -- and the total --.

Column 30,
Line 21, “ratio zinc” should read -- ratio of zinc --.
Lines 22-23, “concentration the” should read -- concentration of the --.
Line 25, “one claims” should read -- one of claims --.
Line 45, “polyketone, fibers” should read -- polyketone fibers --.

Signed and Sealed this

Nineteenth Day of July, 2005

JON W. DUDAS
*Director of the United States Patent and Trademark Office*